US011472172B2

(12) United States Patent
Lao

(10) Patent No.: US 11,472,172 B2
(45) Date of Patent: Oct. 18, 2022

(54) FOIL STAMPING MECHANISM

(71) Applicant: FOSHAN TIANZHENG MACHINERY CO., LTD., Guangdong (CN)

(72) Inventor: Yingzi Lao, Foshan (CN)

(73) Assignee: OSHAN TIANZHENG MACHINERY CO., LTD., Foshan (CN)

( * ) Notice: Subject to any disclaimer, the term of this patent is extended or adjusted under 35 U.S.C. 154(b) by 62 days.

(21) Appl. No.: 17/126,607

(22) Filed: Dec. 18, 2020

(65) Prior Publication Data

US 2021/0221119 A1 Jul. 22, 2021

(30) Foreign Application Priority Data

Jan. 20, 2020 (CN) ..... 202010062724.4

(51) Int. Cl.
*B41F 33/00* (2006.01)
*B41F 16/00* (2006.01)

(52) U.S. Cl.
CPC ..... *B41F 16/0046* (2013.01); *B41F 16/006* (2013.01); *B41P 2219/22* (2013.01)

(58) Field of Classification Search
None
See application file for complete search history.

(56) References Cited

U.S. PATENT DOCUMENTS 5,207,855 A * 5/1993 Nyfeler ..... B42D 25/405 156/361
2002/0117060 A1* 8/2002 Steuer ..... B41F 19/02 101/27

FOREIGN PATENT DOCUMENTS

CN 103802458 A * 5/2014
CN 109605831 A * 4/2019 ..... B29C 59/02

* cited by examiner

*Primary Examiner* — Leslie J Evanisko
(74) *Attorney, Agent, or Firm* — Calfee Halter & Griswold LLP

(57) ABSTRACT

The disclosure discloses a foil stamping mechanism, which includes a base and a lifting seat, wherein a plurality of stamping molds are arranged between the base and the lifting seat, an aluminum foil driving mechanism is arranged above the stamping mold, the aluminum foil driving mechanism includes a connecting plate, a monitoring device is installed on one side of the connecting plate. According to the disclosure, a pattern on an electrochemical aluminum foil can be precisely stamped to a corresponding position on a film roll.

10 Claims, 7 Drawing Sheets

FOIL STAMPING MECHANISM

CROSS-REFERENCE TO RELATED APPLICATIONS

This application claims priority to Chinese Patent Application No. 202010062724.4, filed with the National Intellectual Property Administration, PRC on Jan. 20, 2020 and entitled "FOIL STAMPING MECHANISM", which is incorporated herein by reference in its entirety.

TECHNICAL FIELD

The present disclosure relates to a stamping mechanism, and more particularly, to a film stamping mechanism for rolls.

BACKGROUND

A stamping process is a special printing process without ink, which refers to a technological process of stamping an electro-chemical aluminum foil to a substrate surface under a certain pressure and temperature. Pictures and texts after the stamping process present strong metallic luster effect with brighter colors and being durable without fade for long terms. In particular, hot stamping foil with magnificent and elegant decoration thereof embellished on a surface of a printed matter enhances an artistic quality of the printed matter, and highlights a publicity effect of a theme, so that a finished product looks higher-grade and brings people the enjoyment of beauty. The stamping process has been widely used in high-grade and exquisite packaging and decoration, trademarks, calendars, book covers and other printed matters. In order to make packaging appearances of products attract more consumers, the stamping process is also applied to plastic bags, paper bags or woolen cloth bags of packaging materials.

As stated in Chinese utility model patent with publication number CN208216266U, an existing film stamping machine for bags includes a film unwinding mechanism, a stamping mechanism and a rewinding mechanism. The stamping mechanism is located between the film unwinding mechanism and the rewinding mechanism. The film unwinding mechanism includes a feeding roller and a plurality of conveying rollers, and the feeding roller is connected with a magnetic powder brake. The stamping mechanism includes a base, a lifting seat, and a power rod fixed on the lifting seat and passing through a through hole of the base. A plurality of groups of stamping molds are arranged between the base and the lifting seat; a film leading-in roller is arranged in front of the stamping mold, and an aluminum foil moving mechanism is arranged above the stamping mold. The aluminum foil driving mechanism includes an aluminum foil release roller and a collecting roller. The aluminum foil release roller is connected with the magnetic powder brake, and the collecting roller is connected with a servo motor. The rewinding mechanism includes a rewinding roller connected with a motor. A film roll is sleeved on the feeding roller of the film unwinding mechanism, and the film is pulled through the conveying rollers and the stamping molds, and then fixed on a sleeve of the collecting roller of the rewinding mechanism. Next, an aluminum foil roll is tightly sleeved on the aluminum foil release roller, then the aluminum foil sheet is fixed on the collecting roller after passing through the stamping mold of the stamping mechanism, and then the film is passed through the stamping mold through the leading-in roller. When the servo motor connected with the collecting roller and the motor connected with the rewinding roller are running, the aluminum foil and the film will slowly pass by the stamping mold, as the film and the aluminum foil move, the stamping mold will fix a hot stamping foil layer on the aluminum foil onto the film, thus printing various patterns and texts on the film. The whole printing process is fully automatically controlled, without manual participation, and the production efficiency is high.

However, it is difficult to precisely stamp the specific pattern on the aluminum foil to a corresponding position on the film with the stamping machine mentioned above because the stamping machine mentioned above will produce a certain displacement tolerance in the process of work, and the displacement tolerance will become larger and larger with the continuous progress of the work, then the position of the pattern stamped on the film roll will deviate more and more seriously, which is difficult to find and adjust in time, thus affecting a quality of the stamped product.

SUMMARY

An objective of the present disclosure is to provide a film stamping mechanism capable of precisely stamping a pattern on an electrochemical aluminum foil to a corresponding position on a film roll.

The present disclosure achieves the above-mentioned objective in this way:

A foil stamping mechanism includes a base and a lifting seat, a power rod fixed on the lifting seat and passing through a through hole of the base, wherein a plurality of groups of stamping molds are arranged between the base and the lifting seat, an aluminum foil driving mechanism is arranged above the stamping mold, the aluminum foil driving mechanism includes a connecting plate which is provided with an aluminum foil release roller, a collecting roller and a plurality of guiding rollers, the aluminum foil release roller is connected with a magnetic powder brake, the collecting roller is connected with a servo motor, a monitoring device is installed on one side of the connection plate, the monitoring device includes a photoelectric switch, the photoelectric switch can be movably installed on a guide rod through a sliding sleeve, the guide rod is fixedly connected with a lifting block through a connecting block, the lifting block is sleeved on a sliding rod, two ends of the sliding rod are fixedly connected with a mounting block, the mounting block is fixedly connected with the connecting plate, and the mounting block is provided with a vertical screw stem to adjust lifting of the lifting block.

A light barrier and round rods are installed on the connecting block in front of the photoelectric switch, two round rods are provided, and are respectively located on upper and lower sides of the light barrier.

Three guiding rollers are arranged on upper and lower sides of the round rod, one lower guiding roller is located in front of the stamping mold, one end of the guiding roller is installed on a connector through a strip groove, the other end of the guiding roller is installed on a square strip, and the other end of the square strip is also fixed to the connecting plate through another strip groove; two upper guiding rollers are provided on a plane at a certain angle as a horizontal plane, one end of the guiding roller is installed on the connector, and the other end of the guiding roller is installed on the connecting plate by an outwardly extended convex block.

The connecting plate is provided with an aluminum foil tension adjusting device, the adjusting device includes a limiting cylinder and a swinging roller, a free end of the limiting cylinder is movably connected with a swinging arm, and the other end of the limiting cylinder is movably connected with the connecting plate; the swinging roller is installed at one end of the swinging arm and the other end of the swinging arm is movably installed on an extension block of the connecting plate, the other end of the swinging arm is also fixed with a fork block, a bearing is arranged in a fork mouth of the fork block, the bearing is fixedly connected with a telescopic rod of a potentiometer by a connecting arm, and the potentiometer is fixed on a platform above the connecting plate.

Both the release roller and the collecting roller are sleeved with two opposite conical gears, and the conical gears are fixed on the release roller or the collecting roller by screws passing through screw holes of the conical gears.

Two sides of a top portion of the stamping mold are connected with vertical plates, the vertical plate perforates a through hole of an upper slide plate and is fixedly connected with a hanging strip, and a bottom portion of the upper slide plate is provided with a slide seat, the slide is sleeved on a slide track of the lifting seat, an upper surface of the upper slide plate is provided with a stamping mold plate lock, the stamping mold plate lock is provided with a through hole for a screw stem to pass through, the through hole is provided with a grain matched with a thread of the screw stem, and one end of the screw stem is provided with a rotating handle or a hand wheel.

The stamping mold plate is mainly composed of upper and lower locking blocks hinged together, the lower locking block is fixed on a surface of the upper slide plate, opposite positions of the upper and lower locking blocks are respectively provided with semicircular grooves, the upper and lower semicircular grooves form the through hole, the grain matched with the thread of the screw stem is arranged on an inner wall of the groove of the upper locking block, and free ends of the upper and lower locking blocks are provided with magnets for attracting each other.

A heat-resistant silicon block is installed between a heating plate of the stamping mold and the lifting seat.

A surface of the lifting seat is provided with a graduated scale, and the upper slide plate is provided with a pointer pointing to the graduated scale.

Bearing blocks are fixed on both sides of a heating plate of the stamping mold, a convex strip is arranged inside the bearing block, and the convex strip is inserted into a groove of a hot stamping template to connect the heating plate and the hot stamping template.

The present disclosure has the beneficial effects that: firstly, the photoelectric switch of the monitoring device is adjusted to align the pattern on the aluminum foil. When the pattern on the aluminum foil passes in front of the photoelectric switch of the monitoring device, the monitoring device can accurately measure a distance between two adjacent patterns, and then control an advance length of the film roll according to the distance. Advance lengths of the aluminum foil roll and the film roll are determined by the distance between the two adjacent patterns on the aluminum foil, so that the stamping mold can precisely stamp the pattern on the aluminum foil onto the film roll, without displacement tolerance in the working process, which is practical and reliable. The photoelectric switch can move left and right by loosening the connection between the sliding sleeve and the guide rod; and the upper and lower positions of the photoelectric switch can be adjusted by transferring the vertical screw stem, so as to adapt to stamping the patterns at different positions of the aluminum foil.

BRIEF DESCRIPTION OF THE DRAWINGS

The present disclosure is further explained with reference to the drawings and embodiments hereinafter.

DETAILED DESCRIPTION

Figure 1:
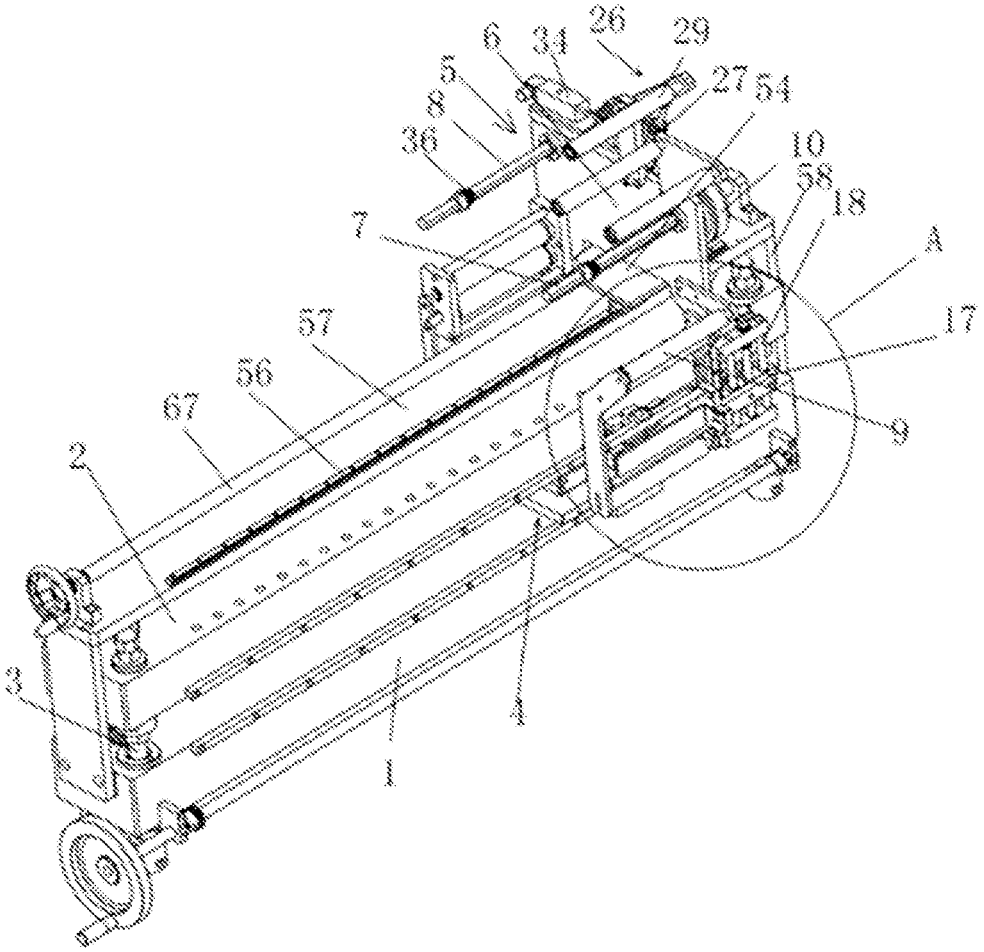
FIG. 1 is a three-dimensional structural diagram of a first embodiment of the present disclosure.
Figure 2:
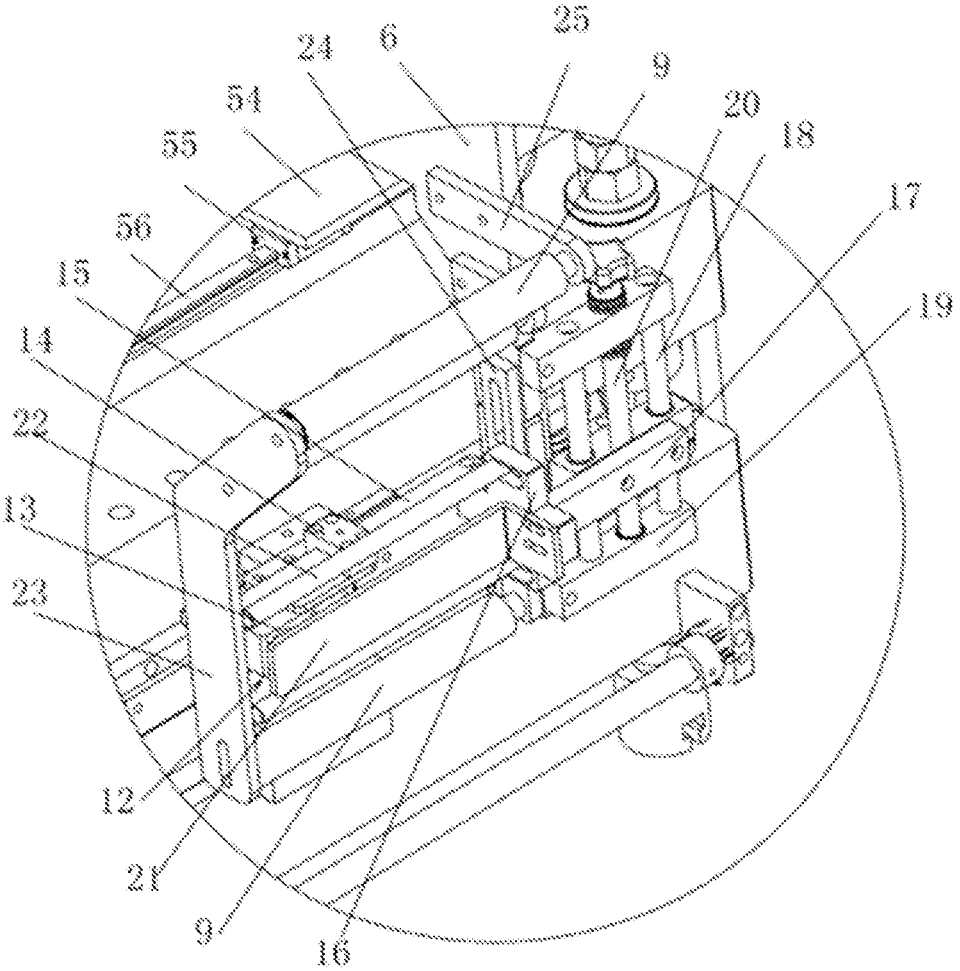
FIG. 2 is an enlarged drawing at a portion A of FIG. 1.
Figure 3:
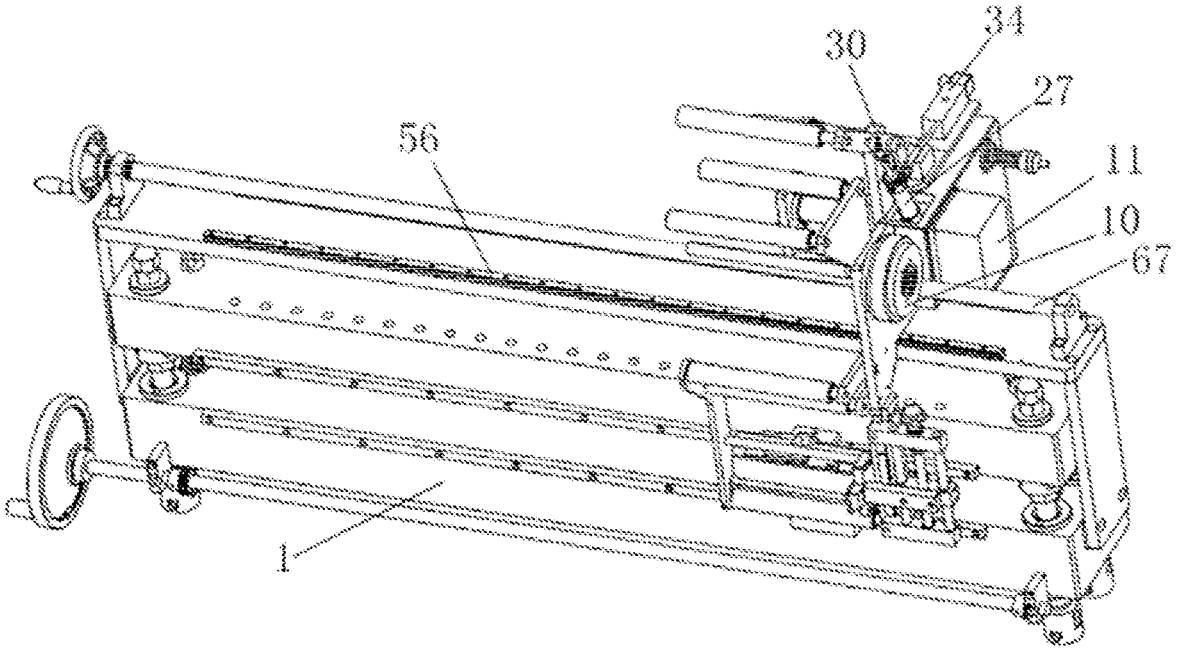
FIG. 3 is a three-dimensional structural diagram of the first embodiment of the present disclosure from another angle.
Figure 4:
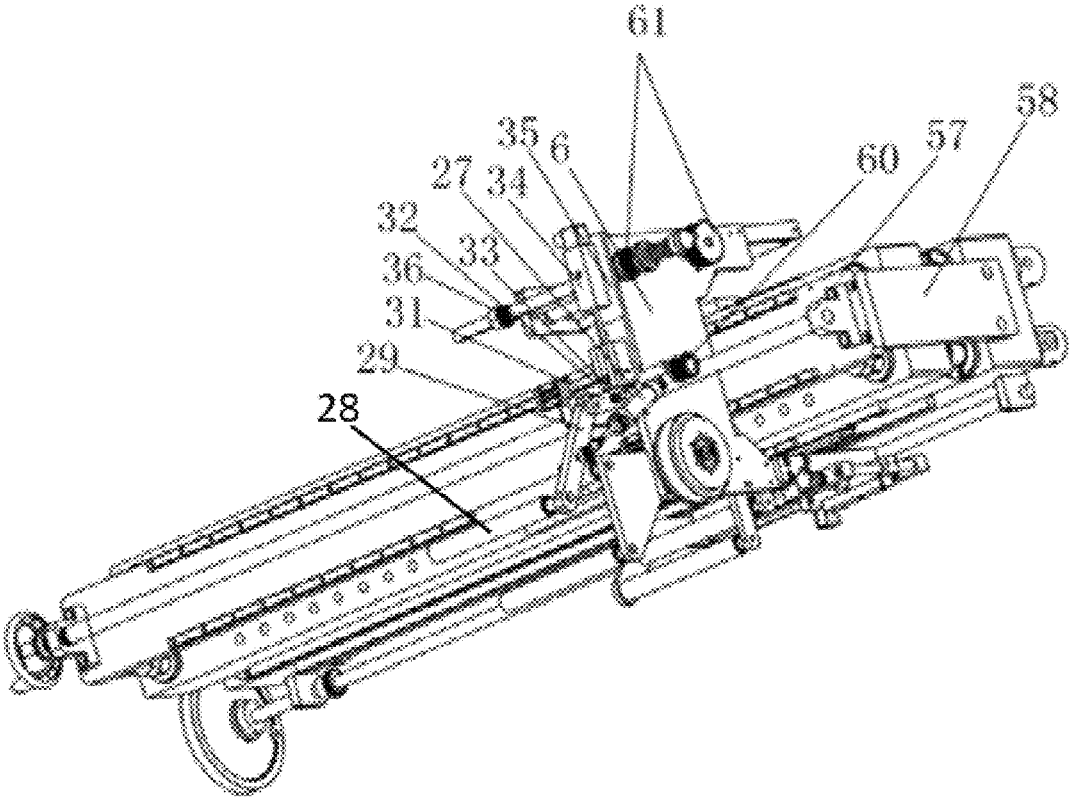
FIG. 4 is a three-dimensional structural diagram of the first embodiment of the present disclosure after removing some parts.

Referring to FIG. 1 to FIG. 4, a foil stamping mechanism includes a base 1 and a lifting seat 2, a power rod 3 fixed on the lifting seat 2 and passing through a through hole of the base 1 wherein a plurality of groups of stamping molds 4 are arranged between the base 1 and the lifting seat 2, and an aluminum foil driving mechanism 5 is arranged above the stamping mold 4. The aluminum foil driving mechanism 5 includes a connecting plate 6. The connecting plate 6 is provided with an aluminum foil release roller 7, a collecting roller 8 and a plurality of guiding rollers 9. The aluminum foil release roller 7 is connected with a magnetic powder brake 10, and the collecting roller 8 is connected with a servo motor 11. A monitoring device 12 is installed on one side of the connection plate 6, and the monitoring device 12 includes a photoelectric switch 13. The photoelectric switch 13 can be movably installed on a guide rod 15 through a sliding sleeve 14, the guide rod 15 is fixedly connected with a lifting block 17 through a connecting block 16, and the lifting block 17 is sleeved on a sliding rod 18. Two ends of the sliding rod 18 are fixedly connected with a mounting block 19, the mounting block 19 is fixedly connected with the connecting plate 6, and the mounting block 19 is provided with a vertical screw stem 20 to adjust lifting of the lifting block 17. Firstly, the photoelectric switch 13 of the monitoring device 12 is adjusted to align a pattern on an aluminum foil. When the pattern on the aluminum foil passes in front of the photoelectric switch 13 of the monitoring device, the monitoring device can accurately measure a distance between two adjacent patterns, and then control an advance length of a film roll according to the distance. Advance lengths of an aluminum foil roll and the film roll are determined by the distance between the two adjacent patterns on the aluminum foil, so that the stamping mold can precisely stamp the pattern on the aluminum foil onto the film roll, without displacement tolerance in the working process, which is practical and reliable. The photoelectric switch 13 can move left and right by loosening the connection between the sliding sleeve 14 and the guide rod 15; and the upper and lower positions of the photoelectric switch 13 can be adjusted by transferring the vertical screw stem 20, so as to adapt to stamping the patterns at different positions of the aluminum foil. The connecting plate 6 is fixed on a supporting plate 54, a lower part of the supporting plate 54 is fixedly connected with a sliding seat 55, the sliding seat 55 is sleeved on a guide rail 56, sliding relative to the guide rail 56, the guide rail 56 is fixed on the supporting plate 57, and the supporting plate 57 is fixedly connected with the base 1 through vertical plates 58 at both ends. Two guide rails 56 are provided, and the same guide rail 56 is connected with the supporting plate 54 by two sliding seats 55. The connecting plate 6 is connected with a driving screw stem 67. By transferring a hand wheel of the driving screw stem 67, the driving screw stem 67 drives the connecting plate 6 to move along the guide rail 56, so as to meet the requirements of stamping different films. The servo motor 11 is connected with a driving gear 60, and the driving gear 60 is connected with two driven gears 61 through a drive belt.

In order to make the photoelectric switch 13 more accurately detect the pattern on the aluminum foil, a light barrier 21 and round rods 22 are installed on the connecting block 16 in front of the photoelectric switch 13, two round rods 22 are provided and are respectively located on upper and lower sides of the light barrier 21. When the aluminum foil passes between the photoelectric switch 13 and the light barrier 21, the light barrier 21 can effectively reduce an influence of external light on the photoelectric switch 13, ensuring that the photoelectric switch 13 can monitor the pattern on the aluminum foil more precisely and measure the distance between two adjacent patterns. The two round rods on the upper and lower sides of the light barrier enable the pattern on the aluminum foil to face the photoelectric switch positively, which is more convenient for the photoelectric switch to measure.

In order to further facilitate the photoelectric switch to measure the distance between two adjacent patterns on the aluminum foil and feed the patterns to the stamping mold more precisely so as to stamp the patterns onto the film roll, three guiding rollers 9 are arranged on upper and lower sides of the round rod 22, wherein one lower guiding roller is located in front of the stamping mold 4, one end of the guiding roller is installed on a connector 23 through a strip groove, the other end of the guiding roller is installed on a square strip 24, and the other end of the square strip 24 is also fixed to the connecting plate 6 through another strip groove. Two upper guiding rollers 9 are provided on a plane at a certain angle as to a horizontal plane, one end of the guiding roller is installed on the connector 23, and the other end of the guiding roller is installed on the connecting plate 6 by an outwardly extended convex block 25, thus ensuring that the aluminum foil passes smoothly and accurately in front of the photoelectric switch.

In order to further ensure the smooth and accurate running of the aluminum foil, and provide convenience for the photoelectric switch 13 to monitor the pattern on the aluminum foil, the connecting plate is provided with an aluminum foil tension adjusting device 26. The adjusting device 26 includes a limiting cylinder 27 and a swinging roller 28. A free end of the limiting cylinder 27 is movably connected with a swinging arm 29, and the other end of the limiting cylinder 27 is movably connected with the connecting plate 6. The swinging roller 28 is installed at one end of the swinging arm 29, and the other end of the swinging arm 29 is movably installed on an extension block 30 of the connecting plate 6. The other end of the swinging arm 29 is also fixed with a fork block 31, a bearing 32 is arranged in a fork mouth of the fork block 31, and the bearing 32 is fixedly connected with a telescopic rod of a potentiometer 34 by a connecting arm 33. The potentiometer 34 is fixed on a platform 35 above the connecting plate 6. When a tension of the running aluminum foil is lower than a certain value or appears in a loose state, the telescopic rod of the potentiometer 34 will be extended, and a brake resistance of the magnetic powder brake 10 at this moment also increase in correspondence to make the running aluminum foil pull tighter; otherwise, vice versa.

Figure 5:
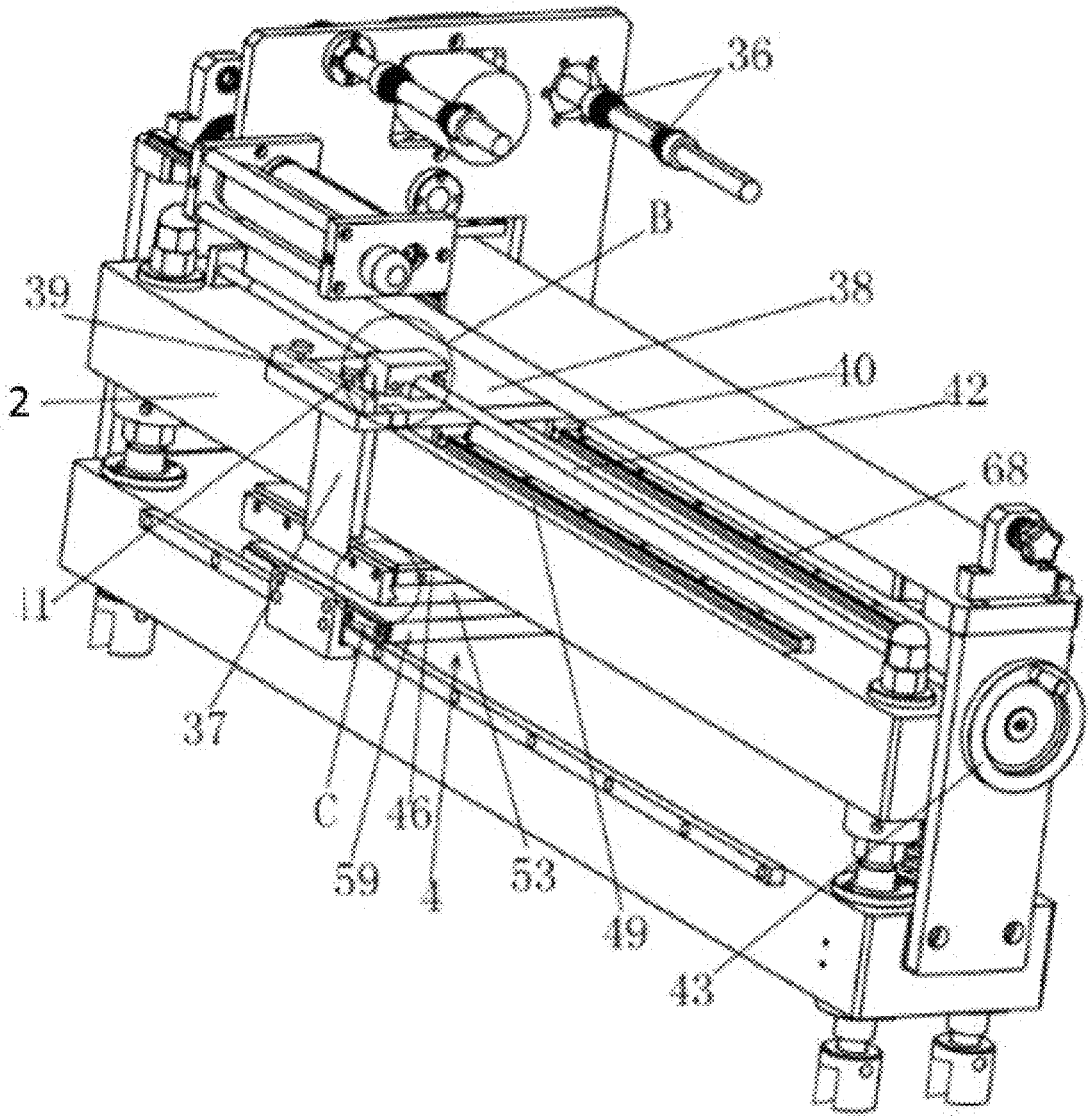
FIG. 5 is a three-dimensional structural diagram of a second embodiment of the present disclosure.
Figure 6:
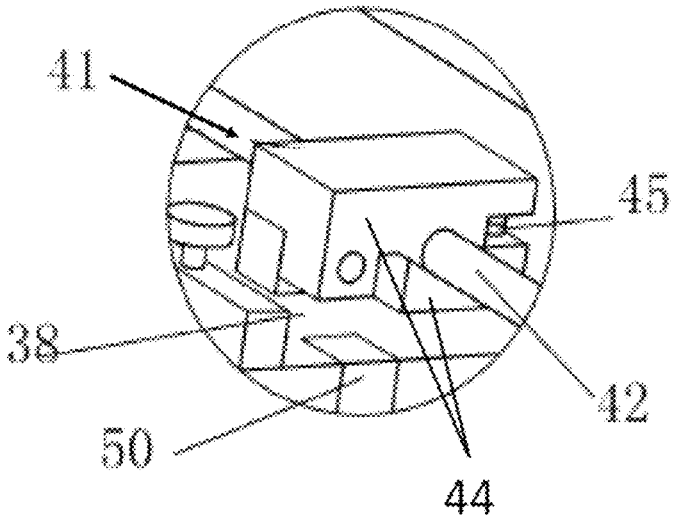
FIG. 6 is an enlarged drawing at a portion B of FIG. 5.
Figure 7:
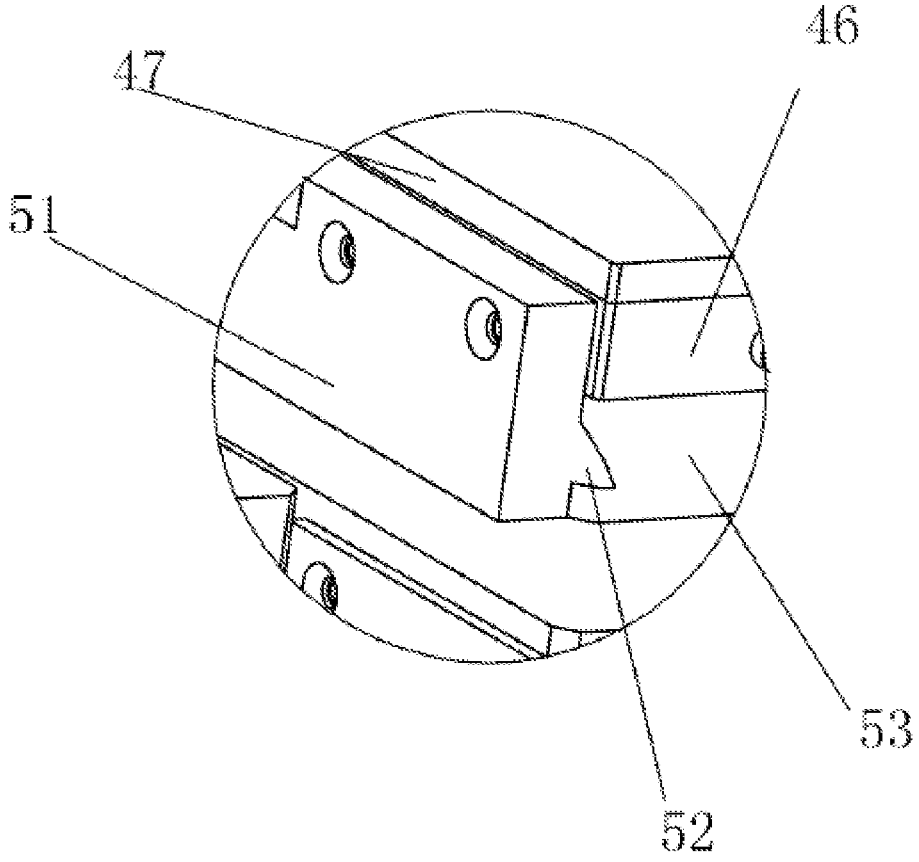
FIG. 7 is an enlarged drawing at a portion C of FIG. 5.

Referring to FIG. 5 to FIG. 6, in order to firmly fix a foil feeding roll and a waste rewinding roll on the release roller 7 and the collecting roller 8 respectively, both the release roller and the collecting roller are sleeved with two opposite conical gears 36, and the conical gears 36 are fixed on the release roller 7 or the collecting roller 8 by screws passing through screw holes of the conical gears. In case of mounting the foil rolls, the outside gears 36 are loosen firstly, and then the outside gears are taken out from the release roller 7 and the collecting roller 8. Then, the outside gears 36 are reinstalled to press the two relative gears 36 on the same roller to tighten the screws on the gears 36 while pressing the foil roll tightly, so that the foil rolls can be firmly fixed on the release roller 7 or the collecting roller 8.

Two sides of a top portion of the stamping mold 4 are connected with vertical plates 37. The vertical plate 37 perforates a through hole of an upper slide plate 38 and is fixedly connected with a hanging strip 39. A bottom portion of the upper slide plate 38 is provided with a slide seat 40, and the slide 40 is sleeved on a slide track 68 of the lifting seat 2. An upper surface of the upper slide plate 38 is provided with a stamping mold plate lock 41, and the stamping mold plate lock 41 is provided with a through hole for a screw stem 42 to pass through. The through hole is provided with a grain matched with a thread of the screw stem 42, and one end of the screw stem 42 is provided with a rotating handle or a hand wheel 43. By rotating the handle or the hand wheel 43, the screw stem 42 will drive the stamping mold plate lock to move. Because the stamping mold plate lock 41 is installed on the surface of the upper slide plate 38, the movement of the stamping mold plate lock 41 will drive the upper slide plate 38 to slide along the slide track on the lifting seat 2. As the upper slide plate 38 slides, the upper slide plate will drive the stamping mold 4 under the lifting seat 2 to move the vertical plate 37. The stamping mold 4 includes a heating plate 46, a hot stamping template 53 and a base plate 59. In a word, as long as the handle or the hand wheel 43 is rotated, the stamping mold 4 can be adjusted and moved to an appropriate position to precisely press a stamping foil onto a packaging film.

The stamping mold plate 41 is mainly composed of upper and lower locking blocks 44 hinged together. The lower locking block is fixed on the surface of the upper slide plate 38. Opposite positions of the upper and lower locking blocks are respectively provided with semicircular grooves. The upper and lower semicircular grooves form the through hole. The grain matched with the thread of the screw stem is arranged on an inner wall of the groove of the upper locking block, and free ends of the upper and lower locking blocks are provided with magnets 45 for attracting each other. When the magnets 45 make the upper and lower locking blocks buckle together, the stamping mold plate lock 41, the upper slide plate 38, the hanging strip 39, the vertical plate 37, the heating plate 46 and the hot stamping template 53 will move with the rotation of the screw stem 42. When the magnets 45 are separated to make the grain on the inner wall of the groove of the upper locking block disengage from the screw stem 42, the above-mentioned parts will not move along with the rotation of the screw stem 42, but the above-mentioned parts can be directly pushed together by human hands for long-distance movement without fine adjustment by the screw stem, which can further facilitate position adjustment of the stamping mold.

Moreover, a screw hole is drilled on the hanging strip 39, and a screw is installed on the screw hole. The screw can be contacted with the upper slide plate 38 through the screw hole. The screw is fixed, so that the screw is tightly pressed on the upper slide plate 38. At this time, the heating plate 46 will stick to the lower part of the lifting seat 2, thus effectively preventing the hot stamping template 53 from moving in the process of work, to ensure that the pattern on the aluminum foil is precisely stamped on the packaging film. At the same time, workers can be effectively prevented from mistakenly rotating the handle or the hand wheel to drive the hot stamping template 53. Even if the screw stem 42 is rotated, because the screw stem 42 is tightly pressed on the upper slide plate 38 and the heating plate 46 is stuck to the lower part of the lifting seat 2, the hot stamping template 53 will not move at this moment, the upper locking block will get rid of magnetic suction of the magnets 45 and jump up under an acting force of the screw stem, to make the grain in the groove of the upper locking block disengaged from the thread of the screw stem, so that the hot stamping template 53 can be prevented from generating unnecessary movement to ensure precise stamping, and meanwhile, the screw stem can be prevented from damage.

In order to make the heating plate 46 more effectively adhere to the lower part of the lifting seat 2 and prevent heat from being transferred to the lifting seat 2, a heat-resistant silicon block 47 is installed between the heating plate 46 of the stamping mold 4 and the lifting seat.

Furthermore, a surface of the lifting seat 2 is provided with a graduated scale 49, and the upper slide plate 38 is provided with a pointer 50 pointing to the graduated scale 49. When the hot stamping template 53 is moving, the pointer 50 on the upper slide plate 38 will also move in the graduated scale 49, so that the workers intuitively grasp a moving distance to further facilitate accurate operation and prevent misoperation.

Furthermore, bearing blocks 51 are fixed on both sides of the heating plate 46 of the stamping mold 4, a convex strip 52 is arranged inside the bearing block 51, and the convex strip 52 is inserted into a groove of the hot stamping template 52 to connect the heating plate 46 and the hot stamping template 53. The connection between the heating plate 46 and the hot stamping template 53 can be easily realized by aligning the groove of the hot stamping template 53 with the convex strip of the bearing block 51 and connecting the groove with the convex strip 52. To remove the connection, it is only needed to pull the groove out of the convex strip. Of course, in order to make the groove and the convex strip be more firmly fixed together, screws and other connectors may be used to connect the two again.

What is claimed is:

1. A foil stamping mechanism, comprising a base and a lifting seat, and a power rod fixed on the lifting seat and passing through a through hole of the base, wherein a plurality of groups of stamping molds are arranged between the base and the lifting seat, an aluminum foil driving mechanism is arranged above a selected stamping mold, the aluminum foil driving mechanism comprises a connecting plate, the connecting plate is provided with an aluminum foil release roller, a collecting roller and a plurality of guiding rollers, the aluminum foil release roller is connected with a magnetic powder brake, and the collecting roller is connected with a servo motor, wherein a monitoring device is installed on one side of the connecting plate, the monitoring device includes a photoelectric switch, the photoelectric switch is capable of being movably installed on a guide rod through a sliding sleeve, the guide rod is fixedly connected with a lifting block through a connecting block, the lifting block is sleeved on a sliding rod, two ends of the sliding rod are fixedly connected with a mounting block, the mounting block is fixedly connected with the connecting plate, and the mounting block is provided with a vertical screw stem to adjust lifting of the lifting block.

2. The foil stamping mechanism according to claim 1, wherein a light barrier and two round rods are installed on the connecting block in front of the photoelectric switch, said two round rods are provided and are respectively located on upper and lower sides of the light barrier.

3. The foil stamping mechanism according to claim 2, wherein three guiding rollers are arranged above and below the two round rods, one lower guiding roller is located in front of a selected stamping mold, one end of the guiding roller is installed on a connector through a strip groove, the other end of the guiding roller is installed on a square strip, and the other end of the square strip is also fixed to the connecting plate through another strip groove; two upper guiding rollers are provided on a plane at a certain angle as to a horizontal plane, one end of the guiding roller is installed on the connector, and the other end of the guiding roller is installed on the connecting plate by an outwardly extended convex block.

4. The foil stamping mechanism according to claim 1, wherein the connecting plate is provided with an aluminum foil tension adjusting device, the adjusting device comprises a limiting cylinder and a swinging roller, a free end of the limiting cylinder is movably connected with a swinging arm, and the other end of the limiting cylinder is movably connected with the connecting plate; the swinging roller is installed at one end of the swinging arm and the other end of the swinging arm is movably installed on an extension block of the connecting plate, the other end of the swinging arm is also fixed with a fork block, a bearing is arranged in a fork mouth of the fork block, the bearing is fixedly connected with a telescopic rod of a potentiometer by a connecting arm, and the potentiometer is fixed on a platform above the connecting plate.

5. The foil stamping mechanism according to claim 1, wherein both the release roller and the collecting roller are sleeved with two opposite conical gears, and the conical gears are fixed on the release roller or the collecting roller by screws passing through screw holes of the conical gears.

6. The foil stamping mechanism according to claim 1, wherein two sides of a top portion of a selected stamping mold are connected with vertical plates, the vertical plate perforates a through hole of an upper slide plate and is fixedly connected with a hanging strip, and a bottom portion of the upper slide plate is provided with a slide seat, the slide seat is sleeved on a slide track of the lifting seat, an upper surface of the upper slide plate is provided with a stamping mold plate lock, the stamping mold plate lock is provided with a through hole for a screw stem to pass through, the through hole is provided with a grain matched with a thread of the screw stem, and one end of the screw stem is provided with a rotating handle or a hand wheel.

7. The foil stamping mechanism according to claim 6, wherein the stamping mold plate lock is mainly composed of upper and lower locking blocks hinged together, the lower locking block is fixed on a surface of the upper slide plate, opposite positions of the upper and lower locking blocks are respectively provided with semicircular grooves, the upper and lower semicircular grooves form the through hole, the grain matched with the thread of the screw stem is arranged on an inner wall of the groove of the upper locking block, and free ends of the upper and lower locking blocks are provided with magnets for attracting each other.

8. The foil stamping mechanism according to claim 6, wherein a heat-resistant silicon block is installed between a heating plate of the stamping mold and the lifting seat.

9. The foil stamping mechanism according to claim 6, wherein a surface of the lifting seat is provided with a graduated scale, and the upper slide plate is provided with a pointer pointing to the graduated scale.

10. The foil stamping mechanism according to claim 6, wherein bearing blocks are fixed on both sides of a heating plate of a selected stamping mold, a convex strip is arranged inside the bearing blocks, and the convex strip is inserted into a groove of a hot stamping template to connect the heating plate and the hot stamping template.

* * * * *